US005960976A

United States Patent [19]

Tsuno

[11] Patent Number: 5,960,976

[45] Date of Patent: Oct. 5, 1999

[54] SAMPLE CONTAINER AND METHOD FOR PRODUCING THE SAME

[75] Inventor: Nobuo Tsuno, Kasugai, Japan

[73] Assignee: NGK Insulators, Ltd., Nagoya, Japan

[21] Appl. No.: 08/951,508

[22] Filed: Oct. 16, 1997

[30] Foreign Application Priority Data

Oct. 18, 1996 [JP] Japan ..... 8-276497

[51] Int. Cl.[6] ..... B65D 25/14

[52] U.S. Cl. ..... 220/62.22

[58] Field of Search ..... 220/62.11, 62.22, 220/62.12, 62.13, 592.22; 428/35.8

[56] References Cited

U.S. PATENT DOCUMENTS

| | | | |
|---|---|---|---|
| 4,034,132 | 7/1977 | Manuel | 220/62.11 |
| 5,139,889 | 8/1992 | Imazu et al. | 220/62.11 |
| 5,300,335 | 4/1994 | Miyazawa et al. | 220/62.11 |
| 5,653,357 | 8/1997 | Miyazawa et al. | 220/62.11 |

FOREIGN PATENT DOCUMENTS

| | | |
|---|---|---|
| 4-330272 | 11/1992 | Japan . |
| 6-86941 | 3/1994 | Japan . |
| 6-99085 | 4/1994 | Japan . |
| WO 94/01529 | 1/1994 | WIPO . |

*Primary Examiner*—Stephen Castellano
*Attorney, Agent, or Firm*—Kubovcik & Kubovcik

[57] ABSTRACT

A sample container for heating a sample stored therein includes a resin layer on the whole inner surface of the container made of metal having a thickness ranging from 0.02 mm to 1.0 mm and the resin layer having a thickness ranging from 1 $\mu$m to 100 $\mu$m. A sample container for heating a sample stored therein includes a metal oxide layer on at least the whole inner surface of the container made of metal having a thickness ranging from 0.02 mm to 1.0 mm.

11 Claims, 1 Drawing Sheet

SAMPLE CONTAINER AND METHOD FOR PRODUCING THE SAME

BACKGROUND OF THE INVENTION AND RELATED ART STATEMENT

The present invention relates to a sample container used in the field of biochemistry, physicochemistry, genetic engineering, or the like. Particularly, it is preferably used as a reaction container for PCR (Polymerase Chain Reaction) method. The present invention further relates to a method for producing the sample container.

In the fields of biochemistry, physicochemistry, genetic engineering, and the like, the PCR method is widely used as a method to obtain a great amount of genes each having a specific nucleotide sequence. In the PCR method, a gene is amplified by making use of the property of being single-strand at a high temperature and double-strand at a low temperature and heat resistant polymerase. By the PCR method, a gene can be exponentially amplified by dissociation and annealing of a gene which is caused by repeating ascendance and descendance of temperature of a sample.

In the PCR method, a sample is stored in a reaction container, and a temperature of a constant temperature bath is raised and lowered at suitable intervals so as to raise and lower a temperature of the sample. As such a sample container, a polypropylene tube has been used because of its excellent chemical resistance and moldability.

Usually, 20–30 cycles of temperature ascendance and descendance are required in order to obtain a desired amount of genes. Accordingly, an efficiency of experimentation depends on a time spent for a temperature ascendance or descendance of a sample to a predetermined temperature. In the fields of biochemistry, physicochemistry, genetic engineering, and the like, not only PCR but also many reactions as well as a general enzyme reaction require a temperature control. Accordingly, a rapid change of a temperature of the sample to a predetermined temperature improves an efficiency of experimentation.

Therefore, from such a view point, there has been desired a development of a sample container which can rapidly conduct heat of a constant temperature bath to a sample. For example, Japanese Patent Laid-Open 4-330272 discloses a sample container in which the outer surface of a Teflon (Trademark, produced by du Pont) tube is coated with a metallic thin film.

However, since the metallic thin film is formed by vapor deposition, sputtering, or the like, and has a thickness of 1 μm or less, a Teflon layer is required to be several hundreds of times or more thicker than a metallic thin film, i.e., 0.3–0.4 mm in order to impart mechanical strength by which the sample container stands the use. Since Teflon has a low heat conductivity, it is impossible to sufficiently enhance heat conductivity of the sample container.

The present invention aims to provide a sample container which has a high heat conductivity and which can rapidly conduct heat of a constant temperature bath to a sample.

SUMMARY OF THE INVENTION

According to the present invention, there is provided a sample container for heating a sample stored therein, comprising, a container made of metal having a thickness ranging from 0.02 mm to 1.0 mm, and a resin layer on the whole inner surface of the container, the resin layer having a thickness ranging from 1 μm to 100 μm.

According to the present invention, there is further provided a sample container for heating a sample stored therein, comprising, a container made of metal having a thickness ranging from 0.02 mm to 1.0 mm, and a metal oxide layer on at least the whole inner surface of the container.

In the aforementioned sample container, a metal constituting the container has a heat conductivity of 20 W/m°k or more. The sample container can be used as a reaction container for the PCR method and is preferably used by being inserted to a throughhole arranged in a constant temperature bath.

According to the present invention, there is furthermore provided a method for producing a sample container for heating a sample stored therein, comprising, preparing a metallic sheet having a thickness ranging from 0.02 mm to 1.0 mm, superposing a resin sheet having a thickness ranging from 1 μm to 100 μm on the metallic sheet to obtain a laminate, and press forming the laminate so that the resin sheet faces inside the container.

According to the present invention, there is furthermore provided a method for producing a sample container for heating a sample stored therein, comprising, preparing a container made of metal having a thickness ranging from 0.02 mm to 1.0 mm, and forming a resin layer having a thickness ranging from 1 μm to 100 μm on the whole inner surface of the container.

According to the present invention, there is furthermore provided a method for producing a sample container for heating a sample stored therein, comprising, preparing a container having a thickness ranging from 0.02 mm to 1.0 mm, and forming a metal oxide layer on at least the whole inner surface of the container.

According to the present invention, there is furthermore provided a method for producing a sample container for heating a sample stored therein, comprising, preparing a resin container having a thickness ranging from 1 μm to 100 μm, forming a first metallic layer on an outer surface of the resin container, and forming a second metallic layer on an outer surface of the first metallic layer so that a total thickness of the metallic layers ranges from 0.02 mm to 1.0 mm.

According to the present invention, there is furthermore provided a method for heating and cooling a sample stored in a sample container, comprising, forming a throughhole for inserting a sample container in a heating and cooling apparatus having a heating element embedded inside a ceramic body, inserting a sample container in said throughhole, the sample container comprising a container made of metal having a thickness ranging from 0.02 mm to 1.0 mm, and a metal oxide layer or a resin layer on the whole inner surface of the container, the resin layer having a thickness ranging from 1 μm to 100 μm, and heating and cooling the sample container.

DETAILED DESCRIPTION OF THE INVENTION

Figure 1:
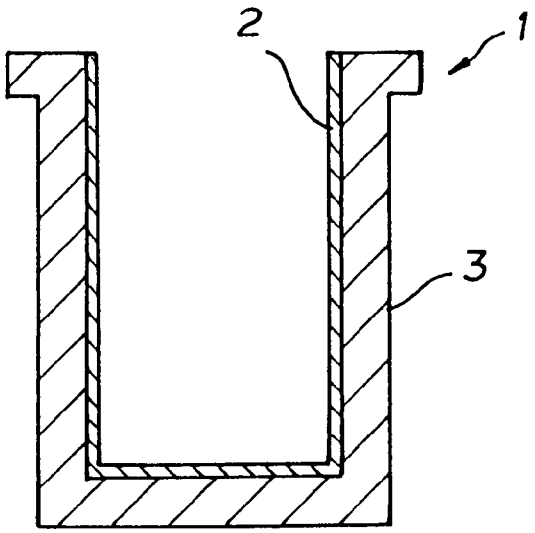
FIG. 1 is a schematic sectional view showing an embodiment of a sample container of the present invention.

A sample container of the present invention has a resin layer on the whole inner surface of the container made of metal. The container made of metal has a thickness ranging from 0.02 mm to 1.0 mm. The resin layer has a thickness ranging from 1 μm to 100 μm.

Since the resin layer has a thickness of 10% or less of a thickness of the container made of metal, a heat conductivity of the sample container is substantially regulated by a heat conductivity of a metal constituting the container. As shown in Table 1, a heat conductivity of a metal is far higher than that of a resin. Accordingly, a container of the present invention has a high heat conductivity in comparison with a conventional container which is mainly made of resin and can rapidly conduct heat of a constant temperature bath to a sample. Accordingly, a time required for one cycle in PCR is greatly reduced, thereby enhancing an efficiency of amplification of a gene in PCR, in which the cycle is repeated 20–30 times. Additionally, efficiencies of various kinds of experiments which need ascendance and descendance of a sample temperature can be improved.

The use of a container of the present invention in combination with a constant temperature bath having excellent heating and cooling properties can bring out the best in the container. As such a container is suitable a container having a structure that a heating element is embedded inside a ceramic body like a constant temperature bath disclosed in PCT International Publication WO 94/01529, or the like.

rapidly conduct heat of a constant temperature bath to a sample even if the sample container is mainly constituted of a metal having a high heat conductivity. Further, since a weight of the sample container is increased, it is difficult to handle the sample container and a production cost is increased. Incidentally, a thickness of the container made of metal is preferably within the range from 0.02 mm to 0.5 mm, and more preferably from 0.02 mm to 0.3 mm.

As a metal constituting a sample container of the present invention, a heat conductivity of the metal is preferably 20 W/m°k or more, more preferably 100 W/m°k or more, and furthermore preferably 200 W/m°k or more. Accordingly, almost all pure metals and alloys on the market can be suitably used. Among them, nickel, molybdenum, aluminum alloy, or the like, having a heat conductivity of 100 W/m°k or more is more suitably used, and silver, copper, gold, aluminum, or the like, having a heat conductivity of 200 W/m°k or more is furthermore suitably used.

By arranging a metal oxide layer at least on the whole inner surface of a container made of metal having a thickness within the range from 0.02 mm to 1.0 mm, a heat conductivity of a sample container can be increased, and heat of a constant temperature bath can be rapidly conducted to a sample. The reason why the metal oxide layer is arranged on the whole inner surface of a container made of metal is to impart chemical resistance to a sample container. Since a heat conductivity of a metal oxide as alumina shown in Table 1 is far higher than a resin such as polypropylene, a heat conductivity of a sample container is improved in this case in comparison with a case that chemical resistance is imparted to a sample container by using a resin. A thickness of the oxide layer is preferably within the range from 0.1 μm to 100 μm, more preferably from 0.1 μm to 50 μm or less, and furthermore preferably 0.1 μm to 10 μm.

TABLE 1

| Material | Heat conductivity (W/m.k) | Material | Heat conductivity (W/m.k) |
|---|---|---|---|
| polypropylene | 0.20 | stainless steel (type 304) | 16.0 |
| Teflon | 0.24 | copper | 398 |
| aluminum | 237 | alumina | 36 |

A thickness of the resin layer is specified to be 1 μm or more. This is because it is difficult to form a resin layer having a uniform thickness of less than 1 μm on the inner surface of the container made of metal. If there is a portion which is not coated with a resin on the inner surface, the sample container may be corroded. A thickness of the resin layer is also specified to be 100 μm or less. This is because a heat conductivity of a sample container is small when the thickness of the resin layer exceeds 100 μm. Accordingly, heat cannot be quickly conducted from a constant temperature bath to a sample. Incidentally, a thickness of the resin layer is preferably within the range from 1 μm to 50 μm, and more preferably from 1 μm to 10 μm. As a resin composing the resin layer, polyimide, ABS resin, polypropylene, acryl, Teflon, poly(butylene terephthalate), or the like, is suitably employed.

In a sample container of the present invention, a thickness of the container made of metal is specified to 0.02 mm or more. This is because if the thickness is less than 0.02 mm, the sample container does not have sufficient mechanical strength, and it is difficult to maintain a definite shape of the sample container and handle it. A thickness of the container made of metal is also specified to 1.0 mm or less. This is because if the thickness exceeds 1.0 mm, it is difficult to A thickness of the container made of metal is specified to be within the range from 0.02 mm to 1.0 mm. This is because of the similar reason to the case that a sample container is constituted by forming a resin layer on the inner surface of a container made of metal. Regarding a metal constituting the sample container, there is suitably a metal similar to one used in the case that a sample container is constituted by forming a resin layer in the inner surface of a container made of metal is formed.

A sample container of the present invention can be produced by various methods according to a shape, a material, a required property, etc.

A sample container in which a resin layer is formed on the whole inner surface of a container made of metal can be produced by superposing a resin sheet having a thickness ranging from 1 μm to 100 μm on a metallic sheet having a thickness ranging from 0.02 mm to 1.0 mm so as to obtain a laminate and then subjecting the laminate to press forming so as to position the resin sheet inside the sample container. Particularly, this method is suitably, employed when a ratio of a depth to an outer diameter of the sample container is small, specifically, within the range of 0.1:1–5:1. A press forming is conducted by a known method.

When a ratio of a depth to an outer diameter of the sample container is large, specifically, a ratio of a depth to an outer diameter is 6:1 or more, there is caused a problem of a breakage of resin because an elongation of a metal is different from that of a resin upon press forming. Accordingly, in this case, a sample container of the present invention may be produced by initially producing a container having a predetermined configuration and dimensions with one of metal or resin, and subsequently, arranging a resin layer or a metal layer on an inner or outer surface of the container, respectively.

When a resin layer is formed on the inner surface of a container made of metal, a metallic container having a thickness ranging from 0.02 mm to 1.0 mm is prepared by a known method such as a press forming, an extrusion forming, or a die casting, and then a resin layer is formed on the inner surface of the metallic container by a method such as spraying, or dipping.

When a metallic layer is formed on the outer surface of a container made of resin, a resin container having a thickness ranging from 1 $\mu$m to 100 $\mu$m is prepared by a known method such as an injection molding, or a press forming, and then the first metallic layer is formed on the outer surface of the resin container by a method such as a vapor deposition or a sputtering, and further, the second metallic layer is formed on the outer surface of the first metallic layer by electrolytic plating, or nonelectrolytic plating so that a total thickness of metallic layers may be within the range from 0.02 mm to 1.0 mm. The metallic layers are formed at two stages because if a metallic layer having a thickness of 0.02 mm or more is formed by a vapor deposition or a sputtering, it needs a lot of cost and a direct electrolytic plating or nonelectrolytic plating makes connection of a metallic layer with a resin container insufficient, thereby deteriorating a heat conductivity of a sample container.

Further, when a sample container having a metal oxide layer on the whole inner surface is produced, a container made of metal having a thickness ranging from 0.02 mm to 1.0 mm is prepared, and then an oxide film is formed at least on an inner surface of the metallic container by a heat treatment or an electrochemical method such as an anodic oxidation, and the like.

A sample container of the present invention may be produced and used one by one or in a condition that many sample containers are connected with one another.

The present invention is described in more detail with reference to Examples. However, the present invention is by no means limited to these Examples.

(EXAMPLE 1)

As shown in FIG. 1, there was produced a sample container 1 having a layer 2 consisting of polypropylene having a thickness of 0.01 mm on the inner surface of a container 3 consisting of aluminum having a thickness of 0.29 mm. A sample in the sample container 1 was tested for a speed of temperature rise.

The sample container 1 had a bottomed cylindrical shape having a depth of 21 mm, an outer diameter of 6 mm, and a thickness of 0.3 mm, which is similar to the size and the shape of a 0.2 ml sample container for PCR method on the market.

First, a sample container containing 0.2 ml of a sample solution was inserted into a throughhole for the sample container in a constant temperature bath having a structure that a heating element is embedded in a ceramic body. Then, the constant temperature bath was switched on to start heating. A time spent for a temperature rise of the constant temperature bath and a sample solution from 25° C. to 95° C. was measured independently to calculate a delay of a temperature rise of a sample solution from a temperature rise of the constant temperature bath. Incidentally, a temperature of the sample solution was measured by a thermocouple which is inserted into the sample container. The results are shown in Table 2.

(EXAMPLE 2 )

Figure 2:
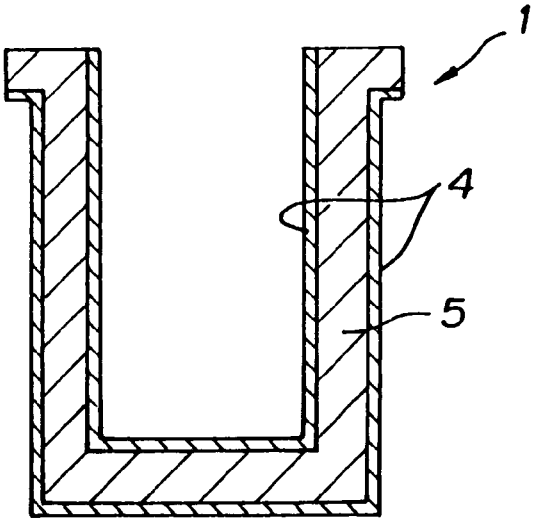
FIG. 2 is a schematic sectional view showing another embodiment of a sample container of the present invention.

As shown in FIG. 2, inner and outer surfaces of a container consisting of aluminum having a thickness of 0.30 mm were oxidized by a heat treatment. A sample container 1 was produced by forming an alumina layer 4 having a thickness of 0.01 mm on each of the inner and the outer surfaces. A sample in the sample container 1 was tested for a speed of temperature rise. The size and the shape of the sample container 1 and a test method were the same as in Example 1. The results are shown in Table 2.

(COMPARATIVE EXAMPLE 1)

A sample in a sample container was tested for a speed of temperature rise with a 0.2 ml sample container consisting of polypropylene having a thickness of 0.30 mm on the market. The size and the shape of the sample container and a test method were the same as in Example 1. The results are shown in Table 2.

TABLE 2

| | Material for sample container | Speed of temperature rise (°C./sec) | Delay of temperature rise (sec) |
|---|---|---|---|
| Example 1 | aluminum(0.29) & polypropylene(0.01) | 9.3 | 3.1 |
| Example 2 | aluminum(0.28) & alumina (0.02) | 9.8 | 3.0 |
| Comparative Example 1 | polypropylene (0.30) | 6.9 | 5.4 |

Note:
Each number in parentheses denotes a thickness.

Table 2 shows that a sample container mainly constituted of aluminum had 40% or more of increase of a speed of temperature rise and a delay of temperature rise is decreased in comparison with one mainly constituted of polypropylene.

Since a sample container of the present invention has a resin layer having a thickness ranging from 1 $\mu$m to 100 $\mu$m on the whole inner surface of a container made of metal or a metal oxide layer at least on the whole inner surface of a container made of metal having a thickness ranging from 0.02 mm to 1.0 mm, a heat conductivity of the sample container is controlled by a heat conductivity of a metal constituting the aforementioned container made of metal. Accordingly, a sample container of the present invention has a high heat conductivity in comparison with a conventional sample container mainly made of resin, and a sample container of the present invention can rapidly transmit heat of a constant temperature bath to a sample. Therefore, a time required for one cycle in PCR is greatly reduced, thereby enhancing an efficiency of amplification of a gene in PCR in which the cycle is repeated 20–30 times. Additionally, efficiency of various experiments requiring temperature ascendance and descendance of a sample can be improved.

What is claimed is:

1. A sample container for heating a sample stored therein, comprising:

a container made of metal having a depth generally of about 21 mm, an outer diameter generally of about 6 mm and a thickness ranging from 0.02 mm to 1.0 mm, said container having a size suitable for use as a sample container in a PCR method, and a resin layer on the whole inner surface of the container, the resin layer having a thickness ranging from 1 $\mu$m to 100 $\mu$m.

2. A sample container according to claim 1, wherein a metal constituting the container has a heat conductivity of 20 W/m°k or more.

3. A sample container according to claim 1, wherein the sample container is adapted to be inserted into a throughhole arranged in a constant temperature bath having a heating element embedded inside a ceramic body.

4. A sample container container according to claim 1, wherein said resin is selected from the group consisting of polyimide, ABS resin, polypropylene, acryl, polytetrafluoroethylene, and poly(butylene terephthalate).

5. A sample container container according to claim 1, wherein the resin layer has a thickness of from 1 $\mu$m to 50 $\mu$m.

6. A sample container container according to claim 1, wherein the resin layer has a thickness of from 1 $\mu$m to 10 $\mu$m.

7. A sample container container according to claim 1, wherein the container has a thickness of from 0.02 mm to 0.5 mm.

8. A sample container container according to claim 1, wherein the container has a thickness of from 0.02 mm to 0.3 mm.

9. A sample container container according to claim 2, wherein a metal constituting the container has a heat conductivity of 100 W/m°k or more.

10. A sample container container according to claim 2, wherein a metal constituting the container has a heat conductivity of 200 W/m°k or more.

11. A sample container container according to claim 2, wherein said metal is selected from the group consisting of nickel, molybdenum, aluminum, silver, copper and gold and alloys thereof.

* * * * *